US006581610B1

(12) United States Patent
Gueret

(10) Patent No.: US 6,581,610 B1
(45) Date of Patent: Jun. 24, 2003

(54) APPLICATOR, APPLICATOR SYSTEM, AND METHOD FOR APPLYING A PRODUCT TO THE EYELASHES

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 09/621,903

(22) Filed: Jul. 21, 2000

(30) Foreign Application Priority Data

Jul. 21, 1999 (FR) ..... 99 09454

(51) Int. Cl.[7] ..... A45D 40/26; A45D 40/24

(52) U.S. Cl. ..... 132/218; 132/317; 132/320

(58) Field of Search ..... 132/218, 320, 132/216, 316, 317; 15/206, 207; 401/122, 129, 126

(56) References Cited

U.S. PATENT DOCUMENTS

| | | | |
|---|---|---|---|
| 155,977 | A | 10/1874 | Rogers |
| 466,496 | A | 1/1892 | Heysinger |
| 791,690 | A | 6/1905 | Grell |
| 1,094,013 | A | 4/1914 | Peterson |
| 1,580,365 | A | 4/1926 | Bechtold |
| 1,670,161 | A | 5/1928 | Meyer |
| 1,780,206 | A | 11/1930 | McKellar |
| 1,829,228 | A | 10/1931 | Lewis |
| 1,892,749 | A | 1/1933 | Philaja |
| 1,963,389 | A | 6/1934 | Vardeman |
| 1,989,185 | A | 1/1935 | Clein |
| 2,077,245 | A | 4/1937 | Locke |
| 2,175,344 | A | 10/1939 | Friedman |
| 2,255,618 | A | 9/1941 | Huppert |
| 2,264,346 | A | 12/1941 | Tupper |
| 2,348,339 | A | 5/1944 | Golden |
| 2,395,002 | A | 2/1946 | Kemmer |
| 2,569,246 | A | 9/1951 | Marcellus |
| 2,596,296 | A | 5/1952 | Shields |
| 2,626,618 | A | 1/1953 | Collison |
| 2,655,925 | A | 10/1953 | Ulvad |
| 2,922,425 | A | 1/1960 | Lerner et al. |

(List continued on next page.)

FOREIGN PATENT DOCUMENTS

| | | |
|---|---|---|
| DE | 25 59 273 | 7/1977 |
| EP | 0 038 524 | 10/1981 |
| EP | 0 474 934 | 3/1992 |

(List continued on next page.)

OTHER PUBLICATIONS

English translation of JP 61–194417.
English translation of JP 61–64817.
English language translation of French Patent No. 1 531 835.

(List continued on next page.)

*Primary Examiner*—John J. Wilson
*Assistant Examiner*—Robyn Kieu Doan
(74) *Attorney, Agent, or Firm*—Finnegan, Henderson, Farabow, Garrett & Dunner, LLP

(57) ABSTRACT

An applicator for applying a product to the eyelashes includes a row of consecutive teeth having substantially aligned roots and portions extending from the roots alternately disposed on opposite sides of a geometric separation surface. The applicator includes a stem with a base portion attached to the stem and the teeth are disposed on the base portion. An application system includes the applicator and a container for containing a product to be applied to the eyelashes. A method of using the applicator includes loading at least some of the teeth with the product and placing at least some of the loaded teeth in contact with the eyelashes.

133 Claims, 8 Drawing Sheets

U.S. PATENT DOCUMENTS

| | | | | | |
|---|---|---|---|---|---|
| 3,033,213 | A | | 5/1962 | Joss et al. | |
| 3,312,583 | A | | 4/1967 | Rochlis | |
| 3,669,130 | A | * | 6/1972 | Petroczky | 132/218 |
| 3,763,870 | A | | 10/1973 | Montgomery et al. | |
| 3,862,639 | A | | 1/1975 | Schefer et al. | |
| 3,892,248 | A | | 7/1975 | Kingsford | |
| 3,896,823 | A | | 7/1975 | Spatz | |
| 3,921,650 | A | | 11/1975 | Montgomery | |
| 3,930,280 | A | | 1/1976 | Vasas | |
| 4,403,624 | A | | 9/1983 | Montgomery | |
| 4,422,986 | A | | 12/1983 | Cole | |
| 4,561,456 | A | | 12/1985 | Gueret | |
| 4,565,205 | A | | 1/1986 | Taylor | |
| 4,635,659 | A | | 1/1987 | Spatz | |
| 4,660,582 | A | | 4/1987 | Taylor | |
| 4,712,936 | A | | 12/1987 | Kessler | |
| 4,744,377 | A | | 5/1988 | Dolan, Jr. | |
| 4,804,004 | A | | 2/1989 | Taylor | |
| 5,007,442 | A | | 4/1991 | Hirzel | |
| 5,046,213 | A | | 9/1991 | Curtis et al. | |
| 5,086,793 | A | * | 2/1992 | Kingsford | 132/218 |
| 5,137,387 | A | | 8/1992 | Byrd et al. | |
| 5,765,573 | A | | 6/1998 | Gueret | 132/218 |
| 5,918,994 | A | | 7/1999 | Gueret | |
| 5,951,185 | A | | 9/1999 | Kingsford et al. | |
| 6,053,179 | A | | 4/2000 | Lhuisset | |
| 6,076,531 | A | | 6/2000 | Gueret | |

FOREIGN PATENT DOCUMENTS

| | | |
|---|---|---|
| FR | 1 000 173 | 2/1952 |
| FR | 1 068 192 | 6/1954 |
| FR | 1 531 835 | 11/1968 |
| FR | 2 564 712 | 11/1985 |
| FR | 2 748 636 | 11/1997 |
| GB | 2 146 520 | 4/1985 |
| GB | 2 159 699 | 12/1985 |
| JP | 61-64817 | 5/1986 |
| JP | 61-194417 | 12/1986 |
| JP | 7-322915 | 12/1995 |
| JP | 9-108033 | 4/1997 |
| JP | 10-215944 | 8/1998 |
| WO | WO 95/17837 | 7/1995 |
| WO | WO 97/28719 | 8/1997 |

OTHER PUBLICATIONS

English language Derwent Abstract of DE 25 59 273.

English language Derwent Abstract of EP 0 038 524.

English language Derwent Abstract of FR 2 748 636.

English language abstract of JP 7–322915.

English language abstract of JP 9–108033.

English language abstract of JP 10–215944.

* cited by examiner

FIG_13
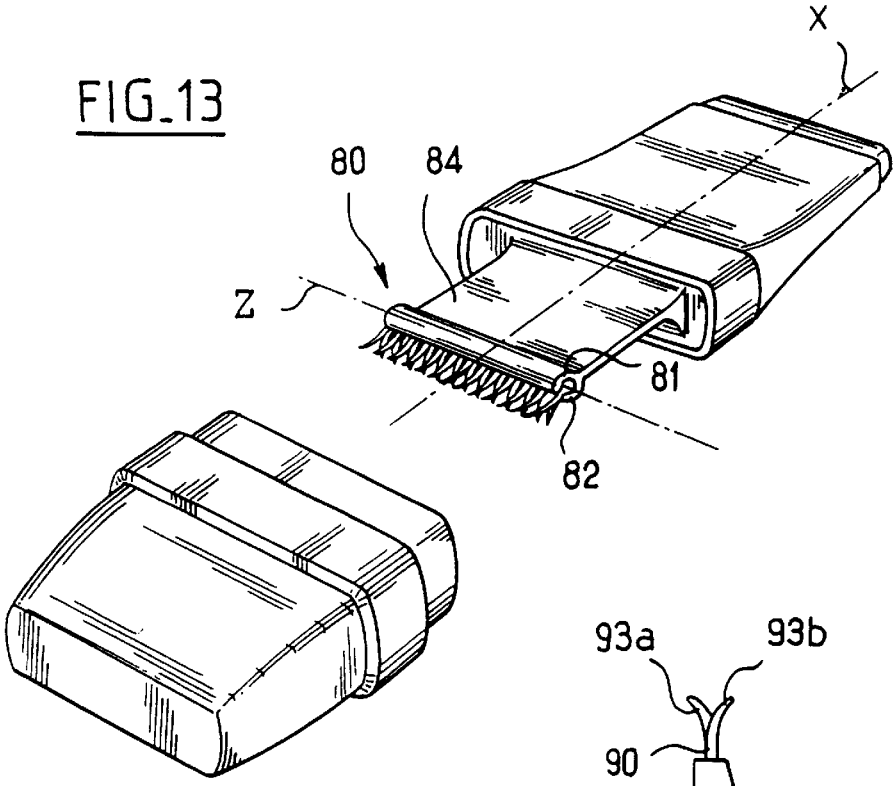
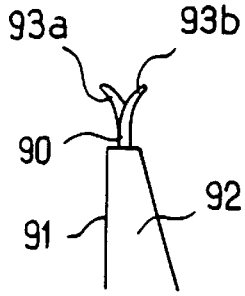
FIG_15
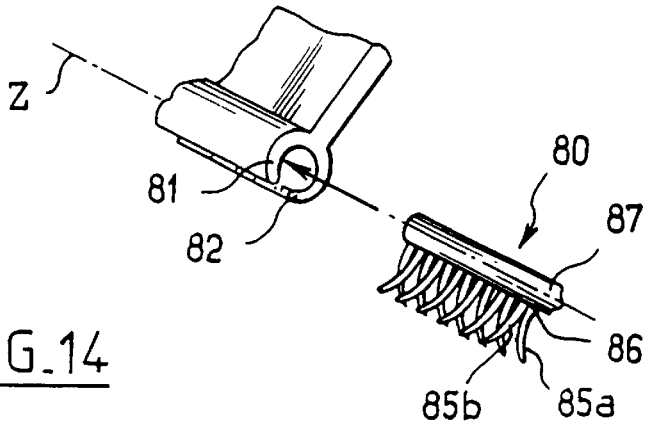
FIG_14

APPLICATOR, APPLICATOR SYSTEM, AND METHOD FOR APPLYING A PRODUCT TO THE EYELASHES

The present invention pertains to an applicator device and methods of using of such devices, for applying a product. In particular, the present invention is directed toward an applicator device for the application of a product, such as a cosmetic product for example, to the eyelashes or eyebrows.

The applicator could be combined with a container for containing the product to be applied. In one embodiment, the container includes a wiper, such as a wringing-out member.

The applicator of the present invention preferably includes a stem (i.e., a wand), with at least one row of a succession of consecutive teeth disposed on one end of the stem. The teeth can be produced by molding plastic. Each tooth in the succession of consecutive teeth comprises a root and a portion extending from the root. The roots of the succession of consecutive teeth are substantially aligned and the portions extending from the roots of the succession of teeth are offset alternately on each side of a geometric separation surface. That is, the extending portion of one tooth is on one side of the geometric separation surface and the extending portion of the next consecutive tooth is on a second side of the geometric separation surface opposite the first side. The applicator can become laden with product between the teeth when the applicator is extracted from the container, and, if present, through the wiper.

The expression "substantially aligned" as used throughout the specification and claims should be understood to mean that one portion of each of the roots of consecutive teeth is disposed on a first side of a line passing through the roots of the consecutive teeth, and another portion of each of the roots of consecutive teeth is disposed on a second side of the line opposite to the first side, wherein the line is substantially parallel to a longitudinal axis of the base portion on which the teeth are disposed. An example of an embodiment with such "substantially aligned" roots includes consecutive teeth disposed such that a straight line passes through the centers of each of the roots of the consecutive teeth. However, other embodiments also are contemplated by the present invention, some of which are shown in the appended figures and will be discussed further in the following description of the invention.

The applicator according to the invention is one wherein the row of teeth includes a succession of consecutive teeth with substantially aligned roots and portions extending from the roots of consecutive teeth alternately disposed on opposite sides of a geometric separation surface.

Substantially aligning the roots of the teeth and alternately disposing portions extending from the roots of consecutive teeth achieves advantages.

For example by modifying the geometry of the teeth and the tooth spacing it is possible to form cavities between the teeth, the size of which can be selected according to the tooth geometry and spacing. These cavities can be filled with product so that greater amounts of product can be loaded onto the application element and thereafter applied.

Moreover, it may be possible to produce an application element capable of becoming laden with a significant amount of product, without thereby reducing the ability of the application element to grip the eyelashes during application of the product.

The teeth may be closely spaced at their roots so that the eyelashes can be gripped effectively between two consecutive teeth. At the same time, widening the spacing between the free ends of consecutive teeth may permit the formation of reservoirs of product on the application element.

The geometric configuration of the teeth also allows small fibers that may be included in the product to become aligned so as to be substantially parallel with each other as the product is applied, or as the teeth are passed through a wiper, or both. This alignment occurs as a result of a bottleneck type of effect that is produced between two consecutive teeth.

The spacing between the roots of two consecutive teeth preferably may be less than or equal to approximately 0.4 mm.

In a preferred embodiment, the geometric separation surface passes through the centers of the roots of the consecutive teeth.

The application element preferably also includes a base portion. The teeth and base portion may be produced by plastic molding, preferably as a single piece construction.

The base portion may be fixed to a stem, for example a wand, of the applicator and the axis of the base portion may be either parallel or at an angle to the axis of the applicator wand or stem.

The geometric separation surface may be a plane, preferably a plane of symmetry of the base portion.

Preferably, the geometric separation surface is a parting line for molding the teeth, or the application element. The geometric separation surface also may be non-planar, for example, twisted, such as a helical surface, or curved.

The height of the roots of the teeth may be greater than or equal to approximately 0.2 mm.

The applicator stem may be flat, substantially cylindrical, or have a number of other configurations depending on the desired application effects and ergonomics. Moreover, at a distal end portion, the stem may include a connector with which the base portion may be removably engageable. In a preferred embodiment, the connector includes a housing or enclosure defining a slot configured to receive the base portion. The housing may also have a longitudinal axis that is either parallel or at an angle to the axis of the stem, for example the longitudinal axis of the housing may be substantially perpendicular to longitudinal axis of the stem. The slot is configured to receive the base portion, and in one embodiment may engage with the roots of the teeth.

The base portion also may be produced by molding plastic as a single piece with the applicator wand or stem.

The application element may be produced by molding plastic as a single piece with the applicator stem and with a sealing member configured to seal the container closed when it is not in use. The sealing member may have a surface shaped to fit in a sealed manner into the neck of the container. Preferably, a cap is disposed at an end of the applicator opposite to an end on which the teeth are disposed, the cap being configured to close the container. The cap also can be provided with the sealing member to sealably close the container.

When the application element is observed along its axis, at least two consecutive teeth may have free ends which diverge away from, converge toward, cross or are substantially parallel to each other. Also, when the application element is observed along its axis, one tooth of at least two consecutive teeth may have a free end diverging away from the free end of the other tooth of the at least two consecutive teeth, while the other tooth may have a free end that is substantially straight.

When the application element is observed along its axis, at least two consecutive teeth may have free ends which are substantially aligned, and preferably three consecutive teeth have substantially aligned free ends.

The application element may include teeth which have free ends directed toward a distal end of the applicator alternating with teeth which have free ends directed toward a proximal end of the applicator.

The teeth may form between them a housing or enclosure having a longitudinal axis substantially parallel to a longitudinal axis of the applicator. The housing or enclosure can be configured to accommodate an internal application element, such as a brush of the twisted wire type, for example.

The applicator may have just one row of teeth, essentially forming a comb. Alternatively, the applicator may have more than one row of teeth disposed at differing angular positions around the applicator, essentially forming a brush. For example, the applicator may include one row of teeth disposed on a substantially opposite side of the applicator as another row of teeth.

The applicator may also include, for example, a base having either a polygonal or non-polygonal cross section. At least one row of teeth preferably extends essentially in the continuation of a side of the base portion when the base has a polygonal shape. When the base portion has a non-polygonal shape, such as a circular or elliptical shape, the roots of the row of teeth connect to the base portion essentially at a tangent. An applicator having these configurations may permit the base portion to apply the product to the eyelashes, and cause a more gradual contact between the eyelashes and the teeth. An applicator having this structure also may promote the curling of the eyelashes.

The applicator may include a stem and an application element on which the teeth are disposed. The application element can be disposed on a distal end portion of the stem. The application element may be made more flexible than the stem. For example, the application element may be made of a plastic having greater flexibility than a plastic used to make the stem. Thus, greater comfort may be obtained when using the applicator.

As an alternative, the stem may be made of a plastic which is more flexible than the material used to make the application element. It is thus possible, for manufacturing reasons, to use a relatively inflexible material to make the application element and to compensate for the inflexibility of the application element at the time of application, using the flexibility of the wand or stem. Similarly, the teeth may be made of a different material than the base portion.

The height of the teeth may vary. As a preference, the height of the teeth ranges from approximately 0.5 mm to approximately 15 mm. More preferably, the height of the teeth ranges from approximately 7 mm to 13 mm.

Another aspect of the invention includes an applicator for applying a product to the eyelashes comprising a stem and a base portion disposed at one end of the stem. The applicator further includes at least one row of teeth including roots disposed on the base portion and portions extending from the roots. The roots of consecutive teeth are substantially aligned and the portions extending from the roots of consecutive teeth are disposed on opposite sides of a geometric separation surface.

The width of the base portion preferably is greater than the width of the roots.

A second row of teeth also may be disposed on the base portion. The second row of teeth may be disposed such that the rows face in substantially opposite directions.

The portions extending from the roots of two consecutive teeth may diverge away from each other. These diverging portions may be near the roots of the teeth.

The teeth may have different lengths and the roots of the teeth may either be in contact with or spaced from one another. The teeth may be disposed on the base portion asymmetrically with respect to a line along which the roots are aligned.

The base portion includes two opposite ends, one of which may be connected to a distal end portion of the stem. Alternatively, the base portion may be connected to a distal end portion of the stem along a part of the base portion located between the opposite ends.

At least one of the teeth may include a hollow portion extending along the length of the tooth. Preferably, at least one side of the tooth has an opening leading to the hollow portion.

As mentioned, the applicator may be part of a system including a container. The container may have a wiper. Preferably, the wiper is deformable, and may include a block of open-cell foam or an elastomeric lip, or other similar suitable configurations.

Another aspect of the invention includes an applicator comprising a stem and a base portion at one end of the stem. At least one row of teeth including roots is disposed on the base portion and the roots of consecutive teeth in the at least one row are substantially aligned along a plane passing through the roots of the consecutive teeth, the consecutive teeth including portions extending from their roots being alternately offset on either side of the plane of alignment.

According to another aspect of the invention an applicator as described in the preceding paragraphs is included with a container configured to contain the product. The applicator and container comprise an applicator system. Preferably, a cosmetic product, such as mascara for example, is contained in the container. The container may include an opening configured to permit passage of at least a part of the base portion of the applicator into the container. The system also may include a cap disposed on an end of the stem opposite to the end of the stem at which the teeth are disposed. The cap may be configured to sealably close the opening of the container.

The invention also includes a method of applying a product to the eyelashes using an applicator or system as described in the preceding paragraphs. The method includes loading a product on at least some of the teeth and placing at least some of the teeth in contact with the eyelashes such that the product coats the eyelashes. The loading may include inserting the applicator or a portion thereof into a container containing the product and removing the applicator from the container and wiping the excess product from the teeth. The loading alternatively may include either dispensing the product from the container onto the teeth or contacting the teeth with a solid cake of product. The solid cake of product preferably may be moistened and the teeth contacted with the moistened cake of product. In the latter form of loading, the moistening step may include either moistening the teeth and then contacting the teeth with the product or moistening the product directly.

The method further comprises gripping the eyelashes between consecutive teeth.

Preferably, the product being applied is mascara. If the mascara includes fibers, the method further includes orienting the fibers with the teeth such that the fibers are substantially parallel to the eyelashes as the product is applied.

When the applicator includes a base portion on which the teeth are disposed and a stem, and the base portion is removably connectable to the stem; the method also may include connecting the base portion of the applicator to the stem. This allows an applicator to include interchangeable base portions having differing teeth configurations disposed thereon. Thus, the user can select various teeth configurations for the applicator as desired to achieve different application effects.

The applicator of the invention, as described above, may be used for applying a cosmetic product, preferably mascara, to the eyelashes. However, other products can be applied to other surfaces and would be obvious to those skilled in the art. In addition, the applicator according to the present invention could also be used to comb the eyelashes or eyebrows, for example.

Aside from the structural and procedural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention.

In the drawings,

FIG. 13 is a perspective view of an applicator system with an applicator device having an application element with a longitudinal axis directed perpendicularly to a longitudinal axis of the applicator stem;

FIG. 14 is a partial sectional view showing the engagement of the application element with a distal end portion of the applicator stem of FIG. 13;

FIG. 15 is a side view of a brush according to an aspect of the present invention with a triangular shaped base portion and having a row of teeth essentially in continuation of with a side of the base portion;

Figure 1:
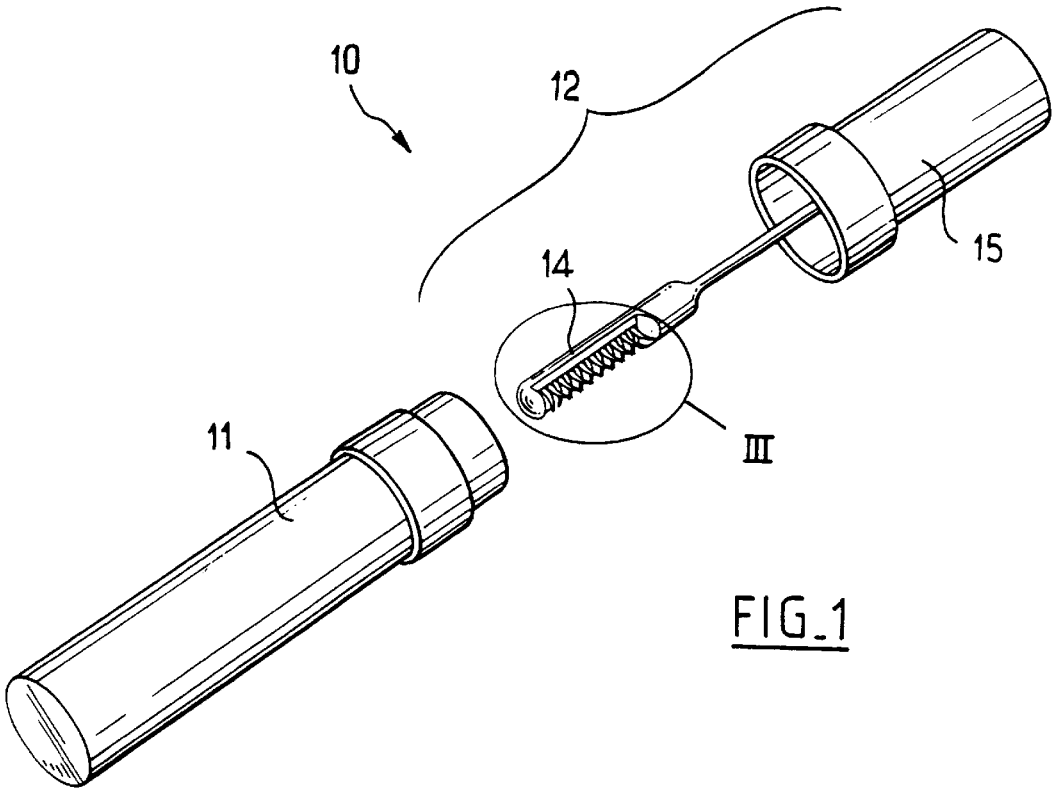
FIG. 1 is a perspective view of an applicator system including the applicator according to a an embodiment of the invention.

Reference will now be made in detail to the Present preferred embodiments of the invention, examples of which are illustrated in the accompanying drawings. Wherever possible, the same reference numbers are used in the drawings and the description to refer to the same or like parts, and the same reference numbers with alphabetical suffixes are used to refer to similar parts.

An applicator system 10 according to an aspect of the present invention is shown in FIGS. 1 through 4. The applicator system 10 shown includes a container 11 containing a product, for example a cosmetic product such as mascara, and an applicator 12. Applicator 12 includes a stem 13 having a longitudinal axis. An application element 14 is disposed on one end of the stem 13 and a handle or grasping element 15 is disposed at an opposite end. Handle or grasping element 15 also may be in the form of a cap for closing the container 11.

Figure 2:
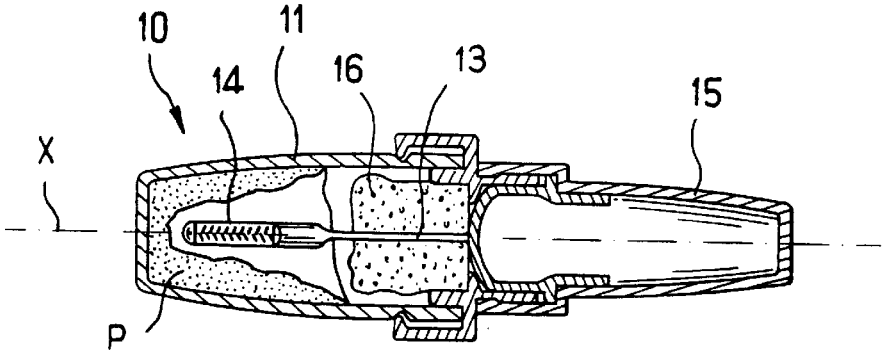
FIG. 2 is a cross-sectional view of the system shown in FIG. 1 with the applicator device inserted in the container having a wiper in the form of a block of open-cell foam according to the present invention.
Figure 2A:
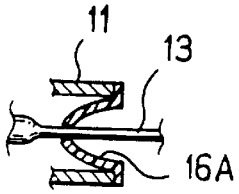
FIG. 2A is a partial cross-sectional view of the system shown in FIG. 1 wherein the wiper is in the form of an elastomeric lip.

The container 11 preferably includes a wringing-out member, or wiper, 16. Wiper 16 may be made of a block of open-cell foam, as shown in FIG. 2, or an elastomeric material, or other similar suitable material. Other types of wringing-out members or wipers may be used, such as, for example, a flexible lip 16A as shown in FIG. 2A, which may or may not be flocked. The wiper should be configured such that it flexes or deforms to the shape of the application element as it passes through the wiper.

When the container is not in use, it is sealed closed, for example by providing a sealing member 9 on the handle, or grasping member, 15 or, alternatively on the applicator stem 13.

As shown in FIGS. 1–4, the application element may be essentially in the form of a comb 14 that includes a single row of teeth disposed on a relatively wide base 17 having a longitudinal axis Z. Preferably, teeth 18 are molded as a single piece with base 17 using plastic. In the embodiments shown, the application element 14 extends from a distal end of the applicator stem 13 and substantially in the same direction as the longitudinal axis of the applicator stem 13.

Over at least a part of its length, the wand or stem 13 has a smaller diameter or width than the comb 14, so as to avoid permanently deforming the wiper 16 or 16A.

The application element 14 preferably includes two series of teeth 18*a* and 18*b* having roots 19 which are substantially aligned along the axis Z of the base 17. Consecutive roots 19 could be contiguous or non-contiguous. At least a part of the length of the upper portions of the teeth 18*a* and 18*b* that extend from the roots are alternately disposed on each side of a geometric separation surface S which, in the figures, is a plane running parallel to the roots 19 of the teeth and containing the axis Z of the base 17. Thus, consecutive teeth have part of the length of their respective upper portions on opposite sides of the geometric separation surface.

The axis Z of the base 17 may be coincident or parallel with the axis X of the stem 13 or make an angle therewith, depending on the desired ergonomics of the applicator.

The height h of the roots 19 of the teeth is on the order of one or a few mm. The overall height of the teeth preferably ranges from approximately 0.5 mm to approximately 15 mm, and more preferably from approximately 7 mm to approximately 13 mm. The heights of the roots of the teeth and the overall height of the teeth need not be uniform, but may vary from each other.

Figure 4:
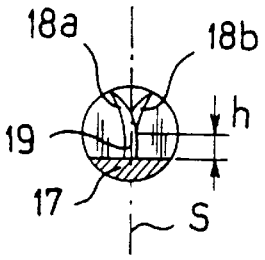
FIG. 4 is a close-up view along line IV—IV of FIG. 3 showing two consecutive teeth of the application element.
Figure 3:
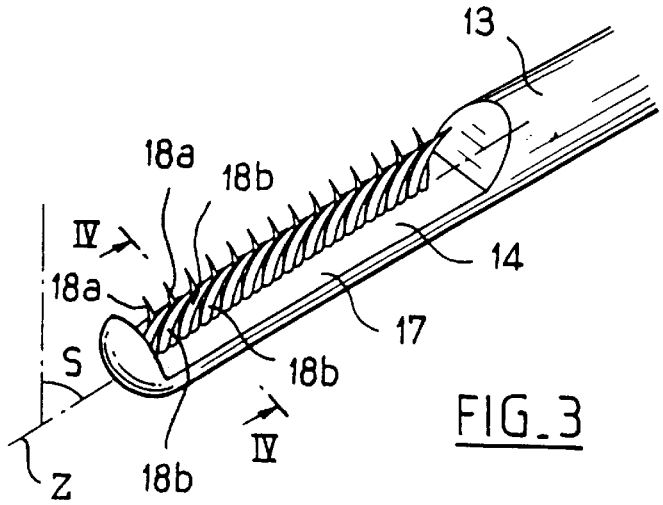
FIG. 3 is a perspective view of the application element of the applicator device of FIG. 1 according to an embodiment of the present invention.

As can be seen in the embodiment shown in FIG. 4, the teeth 18*a* have their respective free ends inclined to the left while the teeth 18*b*, each of which is disposed between two teeth 18*a*, have their respective free ends inclined to the right. By virtue of this configuration of teeth 18*a* and 18*b* on the application element 14, it is possible to have almost zero or very small spacing, for example less than or equal to approximately 0.4 mm, between the roots 19 of the teeth.

The overall length of a row of consecutive teeth preferably ranges from approximately 10 mm to approximately 45 mm, and more preferably from approximately 15 mm to approximately 28 mm. An even further preferred range for the overall length of a row of successive teeth is from approximately 20 mm to approximately 26 mm. The number of teeth per row preferably ranges from approximately 6 to approximately 50, and more preferably from approximately 10 to approximately 35, and even more preferably from approximately 15 to approximately 32.

The configuration of the teeth on the application element is such that two consecutive teeth form notches between them that may allow the application element to grip the eyelashes during application of the product to the eyelashes. This may result in improvements in lengthening and curling of the eyelashes. Moreover, the offset upper portions of the teeth may form between them cavities which are able to hold reservoirs of product on the application element. This may improve loading of the product onto the applicator so that more product can be applied before it is necessary to reload the applicator. Each of these effects, that is, the gripping effect and the product loading effect, helps to improve the appearance of the applied product, and thus overall make-up effect.

Figure 5:
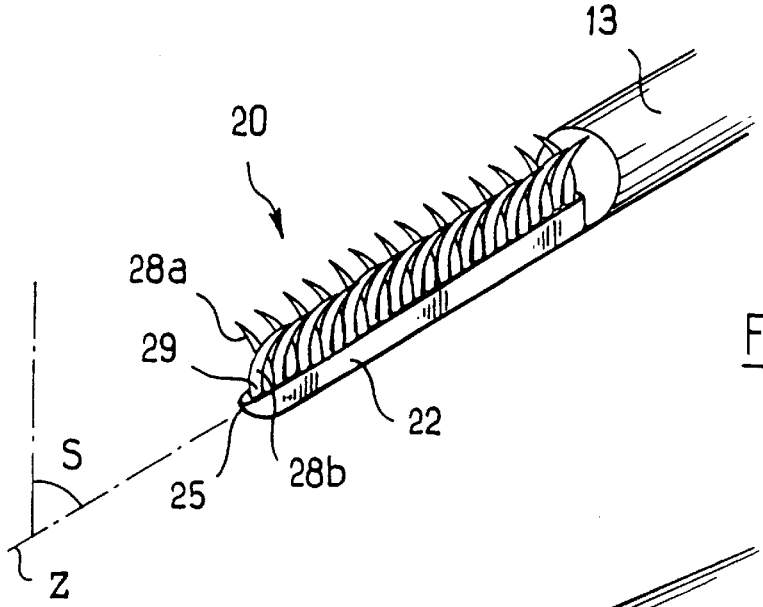
FIG. 5 is a perspective view of the application element showing an arrangement of the teeth according to an embodiment of the invention.

The base of the application element may be embodied in various ways. By way of example, FIG. 5 depicts an application element 20 essentially in the form of a comb including a narrower base 22 and two series of teeth 28*a* and 28*b* forming a row of consecutive teeth. Consecutive teeth 28*a* and 28*b* have roots 29 which are substantially aligned along the axis Z of the base 22, and have upper portions extending from the roots and including the free ends of the teeth, which are arranged alternately on each side of a geometric separation surface S (i.e., the upper portion of tooth 28*a* is on one side of the geometric separation surface S and the upper portion of tooth 28*b* is on the opposite side of the surface S). The geometric separation surface can include a midplane of symmetry of the base 22, for example.

Figure 6:
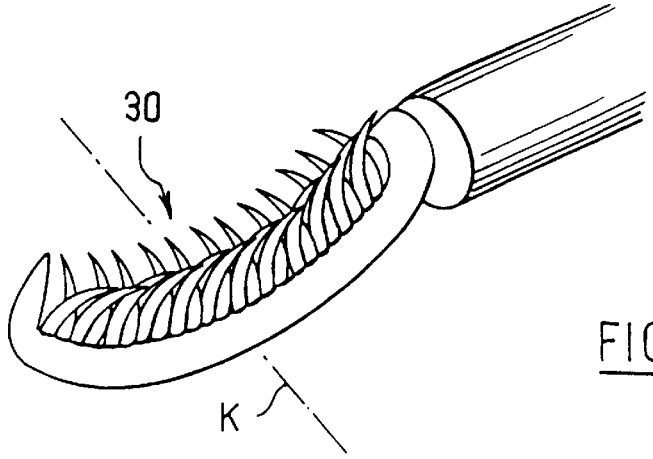
FIG. 6 is a perspective view of the application element showing an arrangement of the teeth according to another embodiment of the invention.

The width of the base 22 in the embodiment shown in FIG. 5 is only slightly greater than the width of the roots 29 of the teeth. The base 22 supporting the teeth of the comb may be straight having a longitudinal axis Z, as shown in FIG. 5, or curved about an axis K, for example, as shown in FIG. 6, or follow a broken or zigzag line (not shown). In the embodiment shown in FIG. 6, axis K is substantially perpendicular to the roots of the teeth of comb 30. However, the base 22 can be curved about an axis other than one perpendicular to the roots of the teeth.

Also shown in FIG. 6 is an application element 30 having teeth with upper portions directed toward the distal end of the application element alternating with teeth with upper portions directed toward the applicator stem, or proximal end of the application element. This arrangement of teeth is in addition to the upper portions of the teeth being offset alternately to the right and to the left.

Figure 7:
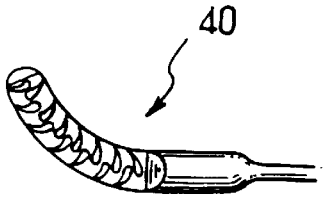
FIG. 7 is a perspective view of the application element showing an arrangement of the teeth according to yet another embodiment of the invention.

The base also may be curved about an axis substantially parallel to the roots of the teeth, as in the embodiment of the application element 40 shown in FIG. 7. In the application element shown in FIG. 7, the geometric separation surface, on either side of which at least portions of the teeth extending from the roots are alternately disposed, is a cylindrical surface with a directrix formed by the axis of the base and a generatrix parallel to the roots of the teeth. The directrix in the embodiment shown is a curved line and the generatrix is perpendicular to the plane of FIG. 7.

If the geometric separation surface is cylindrical, for example, the directrix may in general be a curve or a broken line, such as, for example, a zigzag line.

The geometry of the base portion and the teeth can be chosen according to the type of makeup and the kind of product being applied to the eyelashes, as well as the desired aesthetic effects.

The teeth of the application element may be produced in a number of ways without departing from the scope of the present invention. For example, the two alternating series of teeth may each have teeth with roots having symmetry of revolution. Alternatively, the roots need not have a symmetry of revolution. Moreover, the root of the teeth may have a circular, polygonal, or other similar cross section.

Also, upper parts or free ends of the teeth may have a rounded head or may be hooked (not shown).

In general, the tooth geometry will be chosen according to the nature of the product to be applied to the eyelashes and the desired makeup look.

Figure 8:
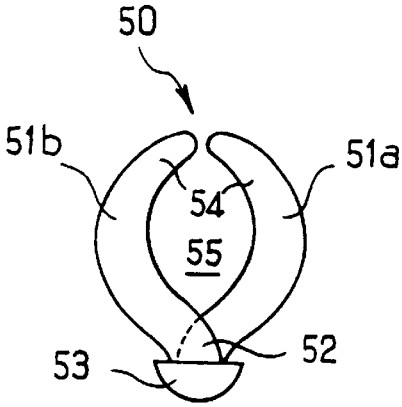
FIG. 8 is a view, looking along the longitudinal axis of the application member, of a base and two consecutive teeth of the application member according to an aspect of the invention.
Figure 9:
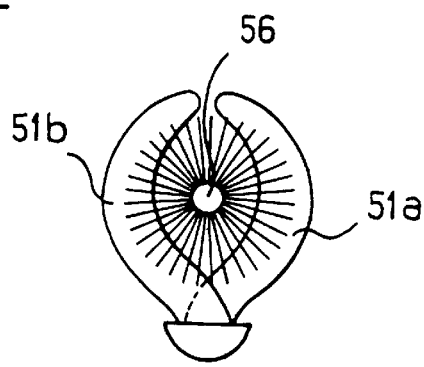
FIG. 9 is a view, looking along the longitudinal axis of the application member, of a base and two consecutive teeth of the application member according to another aspect of the invention.

FIGS. 8–11, 17, and 18 show various configurations of teeth as viewed along the longitudinal axis of the base of the application element. For example, FIG. 8 shows an application element 50 essentially in the form of a comb with two alternating series of teeth 51*a* and 51*b*, the roots 52 of which are substantially aligned on the base portion 53. The teeth 51*a* and 51*b* have overall curved shapes, essentially concave on their respective inside portions, and define a housing, or enclosure 55 between them. Enclosure 55 can accommodate an internal application element brush 56, such as a brush, for example of the twisted wire type, as illustrated in FIG. 9. The free ends 54 of the teeth are directed inward, or converge toward alternating teeth, but do not cross when the comb is observed along the longitudinal axis of the base portion 53.

Figure 10:
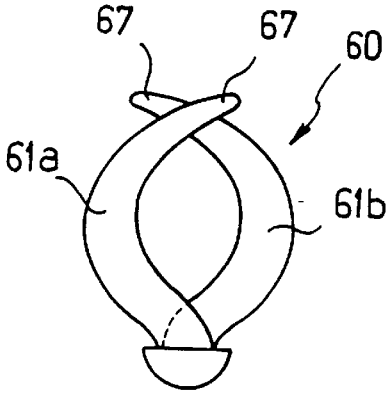
FIG. 10 is a view, looking along the longitudinal axis of the application member, of a base and two consecutive teeth of the application member according to yet another aspect of the invention.

Alternatively, the free ends of the teeth may cross when the comb is observed along the longitudinal axis of the base position. Such a configuration is shown in FIG. 10, in which the free ends 67 of the alternating consecutive teeth 61*a* and 61*b* cross when the comb is observed along the longitudinal axis of the base portion.

Figure 11:
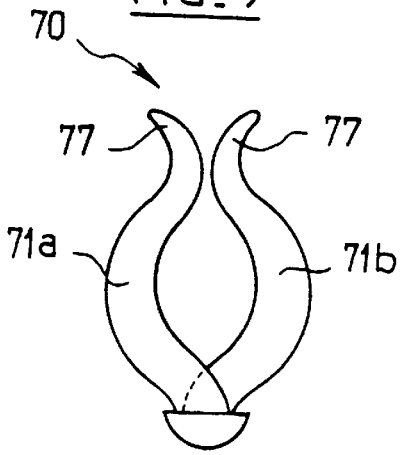
FIG. 11 is a view, looking along the longitudinal axis of the application member, of a base and two consecutive teeth of the application member according to another aspect of the invention.

The free ends of consecutive teeth may also diverge away from each other when the comb is observed along the longitudinal axis of the base, as shown in FIG. 11. As shown, the free ends 77 of the two alternating series of teeth 71*a* and 71*b* of comb 70 diverge.

Additionally, inclining the teeth with respect to the base may result in a tangential contact with the eyelashes at the time of application.

Figure 17:
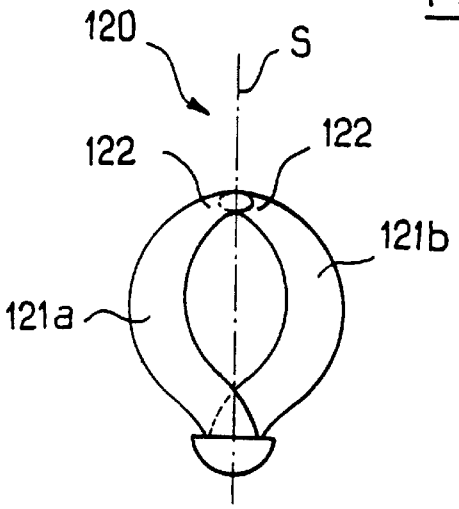
FIG. 17 is a view, looking along the longitudinal axis of the application member, of a base portion and two consecutive teeth of the application member according to another aspect of the invention.

The application element 120 depicted in FIG. 17 has consecutive teeth 121*a* and 121*b* with substantially aligned free ends 122. In the embodiment shown, this alignment occurs along a line parallel to the line on which the roots of the teeth are substantially aligned.

Figure 18:
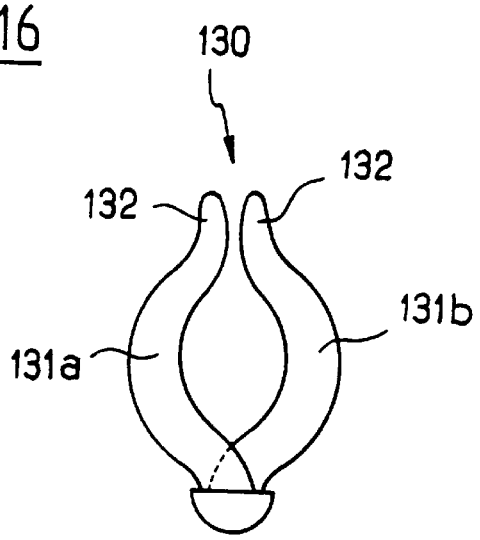
FIG. 18 is a view, looking along the longitudinal axis of the application member, of a base and two consecutive teeth of the application member according to another aspect of the invention.

In another embodiment of the applicator, as shown in FIG. 18, the application element 130 has consecutive teeth 131*a* and 131*b* with free ends 132 extending in a direction substantially parallel to each other. Thus, the free ends 132 point in the substantially the same direction.

Figure 26:
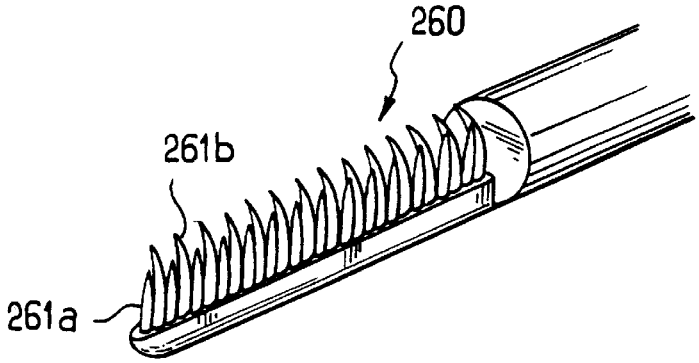
FIG. 26 is a partial perspective view of an applicator having consecutive teeth having free ends alternately diverging away from adjacent teeth and extending substantially straight.

A perspective view of an application element 260 is shown in FIG. 26. Application element 260 includes two series of teeth 261*a* and 261*b* forming a row of consecutive teeth. The roots of consecutive teeth 261*a*, 261*b* are substantially aligned. The free ends of the teeth are arranged such that consecutive teeth alternately have a substantially straight free end, i.e., the free ends of the teeth in the series 261*a* shown in the figure, and a free end that diverges away from the substantially straight free end, i.e., the free ends of the teeth in the series 261*b* shown in the figure.

Figure 27:
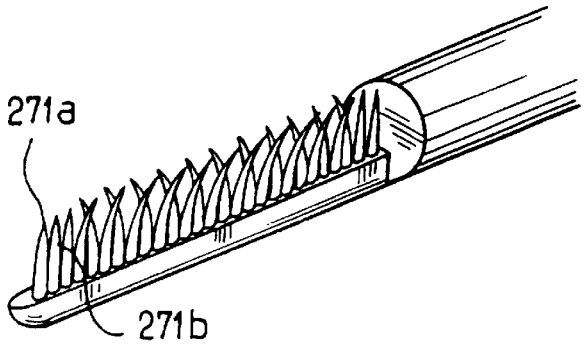
FIG. 27 is a partial perspective view of an applicator having some consecutive teeth with substantially aligned free ends, some consecutive teeth with crossing free ends, some consecutive teeth with diverging free ends, and some consecutive teeth with substantially parallel free ends according to an aspect of the invention.

The application element also may include a combination of consecutive teeth, some of the consecutive teeth having diverging free ends, some having converging free ends, some having aligned free ends, some having crossing free ends, and some having parallel free ends, and any combination thereof, as shown in FIG. 27.

Figure 12:
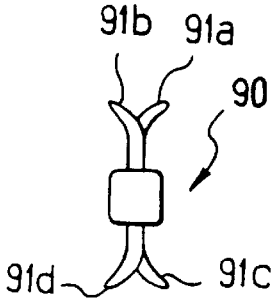
FIG. 12 is an application element having a second row of teeth opposite the first row.

As mentioned above, the invention is not limited to an application element having one row of teeth, but also includes application elements including a, number of rows of teeth, essentially forming a brush, for example. In such brush embodiments, at least one of the rows of teeth has roots which are substantially aligned and portions of the length of the teeth extending from the roots which are offset alternately on each side of a geometric separation surface. For example, the application element may include a second row of consecutive teeth 91*c* and 91*d* opposite the first row of teeth 91*a* and 91*b*, as illustrated by the cross-sectional view of the brush 110 depicted in FIG. 12.

The base portion of the application element may have a polygonal cross-section, for example a triangular cross-section, with one row of teeth extending substantially in continuation of each side. This may make it possible for the eyelashes to come into contact with the base portion to become laden with product at the time of application.

An example of such a polygonal base portion with rows of teeth extending in continuation of each side of the base is shown in FIG. 15. In this figure, a row of successive alternating teeth 93*a*, 93*b* has roots 90 extending substantially in the continuation of a side 91 of the base portion of triangular section.

Figure 16:
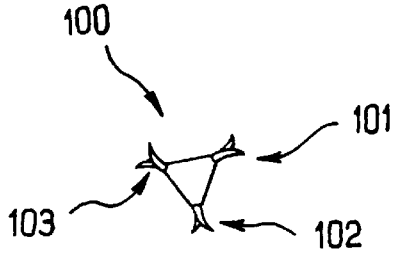
FIG. 16 is a cross-sectional view of a brush according to an aspect of the present invention with three rows of teeth extending essentially radially from a triangular base.

Alternatively, the roots of the rows of teeth may extend radially from the base portion. By way of example, FIG. 16 shows an applicator 100 substantially in the form of a brush having a base of triangular section and three rows 101 to 103 of consecutive teeth. The roots of consecutive teeth in each row are substantially aligned and portions of the length of the teeth extending from the roots are offset alternately on each side of the roots of the teeth. In FIG. 16, the teeth start out from the vertices of the base portion and the roots of different rows of the teeth are oriented radially.

The base portion may have edges to which the teeth are connected and are disposed in a helical array of either constant or variable pitch.

Figure 24:
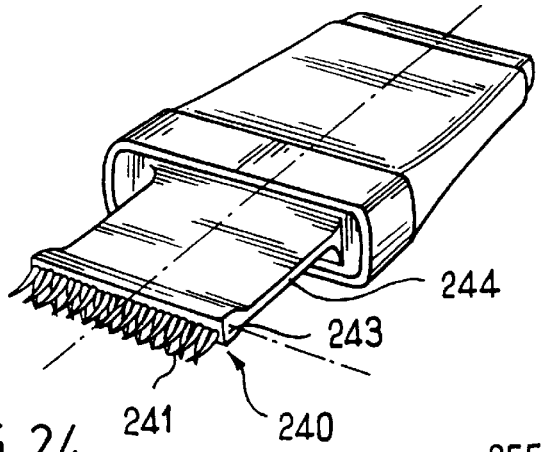
FIG. 24 is a perspective view of an applicator device having a similar configuration as the applicator device of FIG. 13 wherein the base of the application element is molded as a single piece with the stem.

In many of the embodiments that have been described, the base portion extends substantially in the continuation of the applicator stem. That is, a proximal end of the base is attached to a distal end portion of the applicator stem, and a distal end of the base provides a free end of the applicator. FIGS. 13, 14, and 24, however, depict an application element 80 (FIGS. 13 and 14), 240 (FIG. 24) substantially in the form of a comb in which the longitudinal axis Z of the application element extends substantially perpendicularly to the longitudinal axis X of the applicator stem 84 (FIGS. 13 and 14), 244 (FIG. 24). Thus, a lateral surface of the application element or base portion between two opposite ends connects with the distal end portion of the applicator stem. Preferably, the applicator stem is flat, as shown.

The application element 80, shown in FIGS. 13 and 14, includes an alternating series of teeth 85*a* and 85*b* with substantially aligned roots 86, as can be seen most clearly in FIG. 14. These teeth can be produced by molding plastic as a single piece with the base portion 87 and then the base portion 87 can be inserted into a connector 81 in the form of a housing or enclosure formed at the distal end portion of the applicator stem 84. FIG. 14 illustrates the inserting of the base portion 87 of application element 80 into the housing 81, which is preferably performed by sliding along the axis Z.

The housing 81 may define a slot 82 at the front or distal portion to allow the passage of the roots 86 of the teeth 85*a* and 85*b*. Preferably, the width of this slot 82 substantially corresponds to the thickness of the roots 86 of the teeth. Thus, the application element 80 is held in the housing 81 by the fact that the roots 86 are clamped between opposite edges of the slot 82. This mounting allows the application element to be made of an elastomeric plastic and the stem 84 of a rigid or semirigid plastic.

Figure 19:
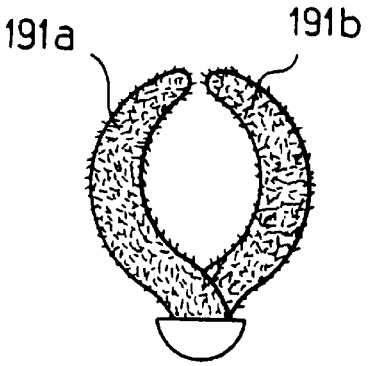
FIG. 19 is a view of a base, looking along the longitudinal axis of the application member, and two consecutive teeth that are flocked according to another aspect of the invention.
Figure 20:
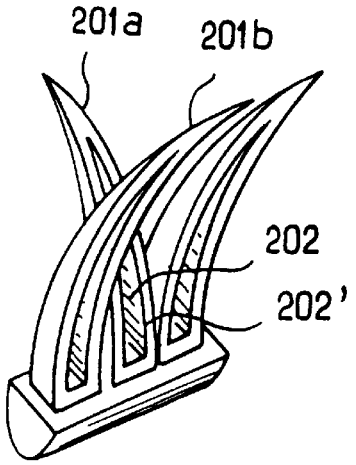
FIG. 20 is a close-up, perspective view of a series of three consecutive teeth that are hollow according to another aspect of the invention.

FIGS. 19 and 20 show various configurations for the teeth of the application member that can assist in achieving desired application characteristics and effects. As shown in FIG. 19, the teeth 191*a*, 191*b* can have flocking distributed on them. This flocking can be included as part of the plastic used to mold the teeth. Furthermore, although not shown, the base portion also can have flocking. As shown in FIG. 20, the teeth 201*a*, 201*b* can have hollow portions 202. The hollow portions preferably extend along at least a portion of the length of the teeth and an opening 202' in the side of the teeth allows access to the hollow portion. These hollow portions may hold product and thus promote the loading of the product onto the applicator in addition to the increased loading effect obtained by the areas formed between the teeth.

Figure 21:
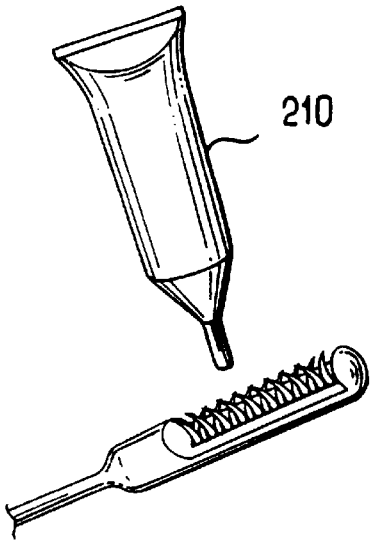
FIG. 21 is a perspective view of another embodiment of an applicator system according to the present invention wherein the product to be applied is dispensed onto the application member from a flexible tubular container.
Figure 22:
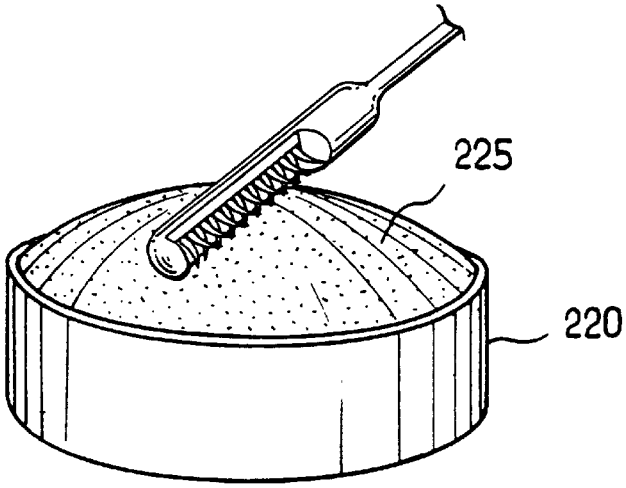
FIG. 22 is a perspective view of yet another embodiment of an applicator system according to the present invention wherein the product to be applied is in the form of a cake or powder.

Alternatives to the applicator system discussed with respect to FIGS. 1 and 2 are shown in FIGS. 21 and 22. FIG. 21 illustrates an applicator system in which the product is stored in a tube-like container 210. This tube preferably is made of a flexible material which when squeezed can dispense product onto the application element of the applicator device. Other dispensers also can be used to dispense the product onto the application element, such as a pump-type dispenser for example, and are considered within the scope of the invention. The applicator system shown in FIG. 22 includes a container 220 holding a solid cake of product 225. This solid cake preferably can be moistened and the application element run through the moistened part of the product to load the product onto the applicator device. Alternatively, the application element can be moistened and run through unmoistened product. For the embodiments shown in FIGS. 21 and 22, it is not necessary to equip the proximal end of the applicator device with a handle or a cap, as the applicator device is not stored in the container containing the product and is not required to close off such a container. Moreover, in these embodiments, the stem itself can be used as a handle.

Figure 23:
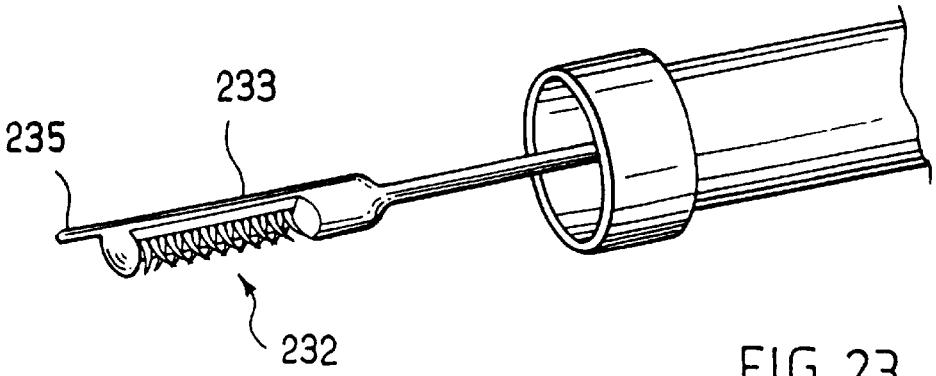
FIG. 23 is a perspective view of an applicator device according to another aspect of the invention wherein the distal end of the application member includes a substantially pointed tip.

FIG. 23 illustrates yet another aspect of the applicator of the present invention. The applicator shown in FIG. 23 includes a pointed tip 235 extending from the base 233 of the application element 232. Upon loading the application element 232 with product, the pointed tip 235 may also become loaded with product and can serve as a tool to line the eyes or as a picking device to pick through individual lashes.

FIG. 24 shows an applicator similar in configuration to the applicator of FIG. 13. However, in the embodiment shown, the base portion 243 is essentially formed as a single piece structure molded with the stem. Similarly, the teeth 241 can be molded as a single piece with the base portion 243 and stem 244.

Figure 25:
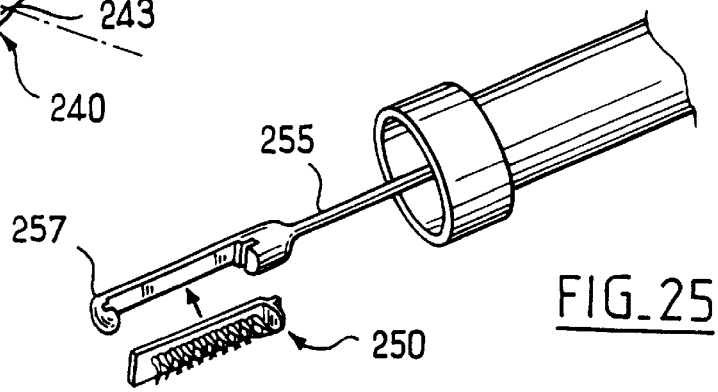
FIG. 25 is a partial perspective view of an applicator wherein the application element is removably engageable with a distal end portion of the stem according to another embodiment of the invention.

FIG. 25 shows another embodiment of the applicator wherein the base portion of the application element can be removably connected to a connector housing formed at a distal end portion of the stem. Again the housing essentially forms a slot with which the base portion of the application element is engageable. In contrast to the embodiment shown in FIGS. 13 and 14, and end of the application element 250, when inserted into the connector 257 at the distal end portion of the stem 255, is connected to the distal end portion of the stem. In FIG. 25, the longitudinal axis of the application element 251, once inserted into the connector 257, extends from the stem in substantially the same direction as the longitudinal axis of the stem.

Figure 28:
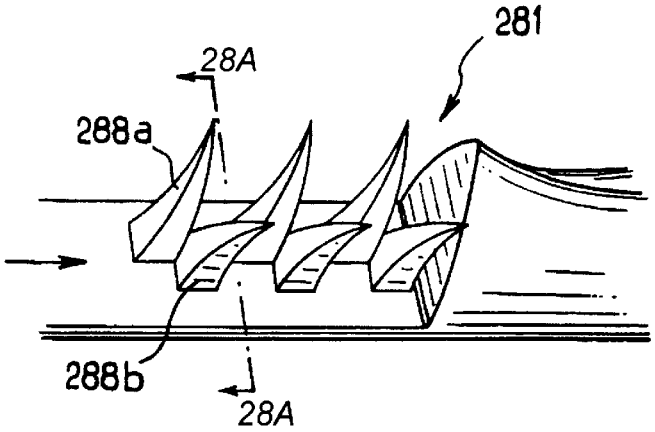
FIG. 28 is a partial top perspective view of an applicator having consecutive teeth with substantially aligned roots and portions extending from the roots diverging away from one another according to an aspect of the invention.
Figure 28A:
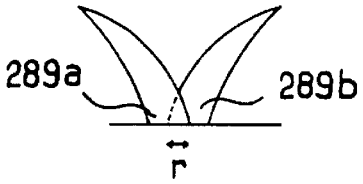
FIG. 28A is a cross-sectional view taken along A—A of the applicator of FIG. 28, showing an example of substantially aligned roots according to an aspect of the invention.

FIGS. 28 and 28A illustrate an example of the disposition of consecutive teeth on the application element 281 wherein the roots 289*a* and 289*b* are "substantially aligned" with each other within the definition of that term as used herein. Thus, as shown most clearly in FIG. 28A, roots 289*a* and 289*b* slightly overlapping each other when the application element is viewed along its longitudinal axis are considered to be substantially aligned.

Figure 29:
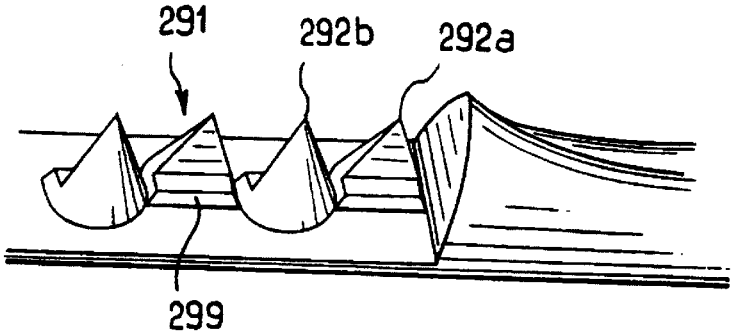
FIG. 29 is a partial top perspective view of an applicator having consecutive teeth with substantially aligned roots according to yet another aspect of the invention.

FIG. 29 illustrates an embodiment of an applicator according to the invention wherein the teeth 292*a* and 292*b* have roots 299 with enlarged portions extending in directions substantially perpendicularly to the longitudinal axis of the portions of the teeth extending from the roots. Thus, consecutive teeth have portions extending from the roots of the teeth alternately extending from opposite sides of the roots, that is alternately from a left side of the roots and a right side of the roots when the application element is observed along its longitudinal axis.

Figure 30:
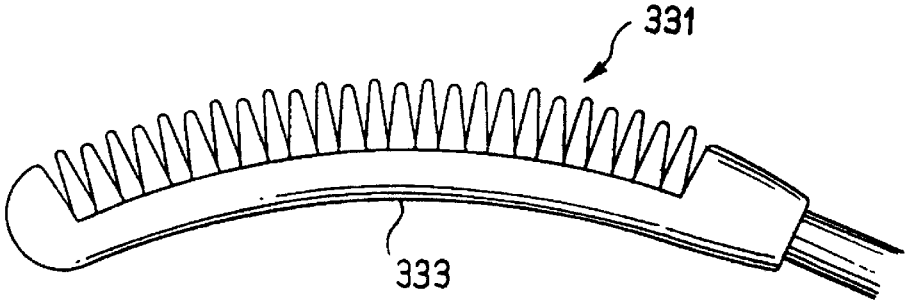
FIG. 30 is a partial side view of an applicator having teeth with differing heights and wherein the base portion of the applicator is flexible according to an aspect of the invention.

FIG. 30 shows an applicator where the application element 331, including the base portion 333, has a curved longitudinal axis. Preferably, the base portion is substantially flexible allowing it to bend as the product is being applied. As shown in FIG. 30, where the surface of the base portion on which the teeth are disposed preferably is convex. This convex configuration causes adjacent teeth to diverge away from each other, thus allowing a relatively large amount of product to be contained between adjacent teeth and consecutive teeth. Moreover, the applicator shown in FIG. 30 may achieve improved loading of the teeth with product as the application element is withdrawn through a wiper. This is because the force of the wiper on the application element will tend to straighten the axis of the application element and cause the teeth to move toward each other, particularly toward a middle portion (along the length) of the application element. As the teeth move toward each other, product may be forced between the teeth toward the base portion, again allowing the application element to hold a relatively large amount of product.

The invention is not restricted to the embodiments which have just been described. For example, the teeth may have shapes other than those that have been described and the teeth need not have the same shape as each other.

In general, the particular features of each of the embodiments described may be combined, according to the type of product to be applied and the application effect desired.

Thus, the application element may include a succession of teeth including a first and a second series of teeth which alternate, the teeth of the first series having a different shape, than the teeth of the second series.

One of the series of teeth may itself be made up of teeth with differing shapes or even differing heights.

The teeth may have a height varying according to the axial position along the application element, for example a height which increases, decreases, decreases then increases or increases then decreases from one end of the application element to the other.

The teeth may have a surface condition which increases the amount of product with which the application element becomes laden. For instance, the teeth and/or the base portion may include capillary grooves or flocking, over all or parts of their surface. An example of such flocking on the teeth is shown in FIG. 19.

The teeth may undergo a surface treatment by abrasion so as to form forks at the ends of the teeth, for example.

The teeth may undergo a heat treatment, for example, to round their tips or form a bubble at their free end. The teeth thus become less aggressive toward the eyelashes.

The teeth, base portion, or both may be also coated with a gliding agent, such as a lacquer or Teflon, for example, to make them glide better along the eyelashes or, alternatively, to give them greater roughness. Such gliding agents may alternatively, or in addition be added to the material used to form the teeth.

The application element, and especially the teeth, may also include active ingredients, such as preservatives, moisturizers, copper salts, magnetic particles, and other similar suitable materials, to be released into the product when the product is loaded onto the application element. These active ingredients can either be included in the material used to form the application element, or can be coated onto the application element, or both. In addition, products that modify the surface tension of the application element upon contact with moisture can be used to form the teeth or to coat the teeth.

The application element is preferably made by the injection-molding of plastic, but as an alternative, use may be made of methods for shaping material by compression, stamping or turning.

The base portion may include grooves or reliefs configured to hold the product.

Although numerous configurations for the teeth on the comb are contemplated by the invention, in each of the embodiments described, preferably the length of a row of consecutive teeth will range from approximately 10 mm to approximately 45 mm, and more preferably from approximately 15 mm to approximately 28 mm, and even more preferably from approximately 20 mm to approximately 26 mm. The individual lengths of each tooth will preferably range from approximately 0.5 mm to approximately 15 mm, and more preferably from approximately 7 mm to approximately 13 mm. The number of teeth in a row of consecutive teeth will preferably range from approximately 6 to approximately 50, and more preferably from approximately 10 to approximately 35, and even more preferably approximately 15 to approximately 32.

It will be apparent to those skilled in the art that various modifications and variations can be made to the structure and methodology of the present invention without departing from the scope or spirit of the invention. Thus, it should be understood that the invention is not limited to the embodiments and examples discussed in the specification. Rather, the present invention is intended to cover modifications and variations of this invention, provided they fall within the scope of the following claims and their equivalents.

What is claimed is:

1. A system for applying a product to the eyelashes, comprising:

a container configured to contain the product; and an applicator including at least one row of teeth, said at least one row of teeth including a succession of consecutive teeth, each tooth in the succession of teeth including a root and a portion extending from the root, wherein the roots of the consecutive teeth are substantially aligned and the portions extending from the roots of the consecutive teeth are offset alternately on each side of a geometric separation surface, and wherein the applicator is configured to apply the product to the eyelashes.

2. The system of claim 1, wherein the teeth are made of plastic.

3. The system of claim 1, further comprising a base portion on which the teeth are disposed.

4. The system of claim 3, wherein said teeth and said base portion are made of plastic.

5. The system of claim 1, wherein said applicator further comprises a stem.

6. The system of claim 5, wherein said applicator further comprises a base portion on which the teeth are disposed.

7. The system of claim 6, wherein said base portion is configured to be removably connected to said stem.

8. The system of claim 7, wherein said stem is substantially flat.

9. The system of claim 7, wherein the base portion is removably engageable with a connector at a distal end portion of the stem.

10. The system of claim 9, wherein the connector defines a slot configured to receive the base portion.

11. The system of claim 6, wherein said base portion is molded as a single piece with the stem.

12. The system of claim 1, further comprising a sealing member for sealably closing the container.

13. The system of claim 12, further comprising a cap disposed on an end of the applicator opposite to an end on which the teeth are disposed.

14. The system of claim 13, wherein the cap includes the sealing member for sealably closing the container.

15. The system of claim 1 wherein when the applicator is observed along a longitudinal axis of a portion of the application element on which the teeth are disposed, at least two consecutive teeth have free ends diverging away from each other.

16. The system of claim 1, wherein when the applicator is observed a long a longitudinal axis of a portion of the application element on which the teeth are disposed, at least two consecutive teeth have free ends converging toward each other.

17. The system of claim 1, wherein when the applicator is observed along a longitudinal axis of a portion of the application element on which the teeth are disposed, at least two consecutive teeth have free ends crossing each other.

18. The system of claim 1, wherein, when the applicator is observed along a longitudinal axis of a portion of the application element on which the teeth are disposed, at least two consecutive teeth have free ends substantially parallel to each other.

19. The system of claim 1, wherein, when the applicator is observed along a longitudinal axis of a portion of the application element on which the teeth are disposed, at least two consecutive teeth have free ends substantially aligned with each other.

20. The system of claim 19, wherein the at least two consecutive teeth include three consecutive teeth.

21. The system of claim 1, wherein the applicator includes consecutive teeth having free ends directed toward a distal end of said applicator alternating with teeth having free ends directed toward a proximal end of said applicator.

22. The system of claim 1, wherein when the applicator is observed along a longitudinal axis of a portion of the application element, one tooth of a pair of consecutive teeth is substantially straight and the other tooth of the pair diverges away from the substantially straight tooth.

23. The system of claim 1, wherein the teeth define an enclosure between them, said enclosure having a longitudinal axis substantially parallel to a longitudinal axis of the applicator.

24. The system of claim 23, wherein the enclosure is configured to accommodate an internal application element.

25. The system of claim 24, wherein the internal application element includes a brush member.

26. The system of claim 23, further comprising an internal application element disposed in the enclosure.

27. The system of claim 26, wherein the internal application element includes a brush member.

28. The system of claim 1, wherein the applicator includes a stem and an application element on which the teeth are disposed, said application element being disposed on a distal end of said stem.

29. The system of claim 28, wherein the application element is made of a plastic that is more flexible than a plastic used to make the stem.

30. The system of claim 28, wherein the application element is made of a plastic that is less flexible than a plastic used to make the stem.

31. The system of claim 1, wherein the geometric separation surface passes through the roots of the consecutive teeth.

32. The system of claim 1, wherein the geometric separation surface is a plane.

33. The system of claim 1, wherein the teeth are disposed on a base portion and the geometric separation surface is a plane of symmetry of the base portion.

34. The system of claim 1, wherein the geometric separation surface is non-planar.

35. The system of claim 1, wherein the geometric separation surface is twisted.

36. The system of claim 1, wherein the roots of the teeth have a height of at least approximately 0.2 mm.

37. The system of claim 1, wherein the distance between the roots of two consecutive teeth is not greater than approximately 0.4 mm.

38. The system of claim 1, wherein at least some of the teeth have differing heights.

39. The system of claim 1, wherein the teeth have a height ranging from approximately 0.5 mm to approximately 15 mm.

40. The system of claim 1, wherein the teeth have a height ranging from approximately 7 mm to approximately 13 mm.

41. The system of claim 1, wherein the applicator includes a single row of consecutive teeth forming a comb-like configuration.

42. The system of claim 1, wherein the applicator includes a plurality of rows of teeth forming a brush-like configuration.

43. The system of claim 3, wherein the base portion has a cross-section chosen from a polygonal cross-section and non-polygonal cross section.

44. The system of claim 43 wherein the base portion has a polygonal cross section and the applicator includes at least one row of consecutive teeth having roots extending substantially in the continuation of a side of the base portion.

45. The system of claim 43, wherein the base portion has a non-polygonal cross-section and the applicator includes at least one row of consecutive teeth having roots extending substantially tangentially to the base portion.

46. The system of claim 1, wherein the roots are substantially aligned along a longitudinal axis of the row.

47. The system of claim 1, further comprising a wiper configured to remove excess product from the teeth when the applicator is removed from said container.

48. The system of claim 47, wherein the wiper is deformable.

49. The system of claim 47, wherein the wiper is chosen from an elastomeric lip and a block of foam.

50. The system of claim 1, wherein the product is contained in the container and the product is a cosmetic product.

51. The system of claim 50, wherein the product is mascara.

52. An applicator for applying a product to the eyelashes, comprising:

a stem;

a base portion disposed at one end of the stem; and at least one row of teeth including roots disposed on the base portion and portions extending from the roots, the roots of the teeth being substantially aligned, wherein the portions extending from the roots of consecutive teeth are disposed on opposite sides of a geometric separation surface, and wherein the applicator is configured to apply the product to the eyelashes.

53. The applicator of claim 52, wherein a width of the base portion is greater than a width of the roots.

54. The applicator of claim 52, further comprising a second row of teeth disposed on said base portion.

55. The applicator of claim 54, wherein the rows of teeth are disposed such that the rows face in substantially opposite directions.

56. The applicator of claim 52, wherein the free ends of consecutive teeth cross one another when said applicator is viewed along a longitudinal axis of the row.

57. The applicator of claim 52, wherein at least portions extending from the roots of two consecutive teeth diverge with respect to each other.

58. The applicator of claim 57, wherein the diverging portions are near the roots of the teeth.

59. The applicator of claim 52, wherein said teeth are configured to apply said product to the eyelashes.

60. The applicator of claim 59, wherein a length of the teeth ranges from approximately 0.5 mm to approximately 15 mm.

61. The applicator of claim 59, wherein a length of the teeth ranges from approximately 7 mm to approximately 13 mm.

62. The applicator of claim 59, wherein a length of the teeth is approximately 15 mm.

63. The applicator of claim 59, wherein a length of said row of teeth ranges from approximately 10 mm to approximately 45 mm.

64. The applicator of claim 59, wherein a length of said row of teeth ranges from approximately 15 mm to approximately 28 mm.

65. The applicator of claim 59, wherein a length of said row of teeth ranges from approximately 20 mm to approximately 26 mm.

66. The applicator of claim 59, wherein a number of teeth in said row ranges from approximately 6 to approximately 50.

67. The applicator of claim 59, wherein a number of teeth in said row ranges from approximately 10 to approximately 35.

68. The applicator of claim 59, wherein a number of teeth in said row ranges from approximately 15 to approximately 32.

69. The applicator of claim 52, wherein said base portion is formed as a single piece with said stem.

70. The applicator of claim 52, wherein said roots of adjacent teeth contact one another.

71. The applicator of claim 52, wherein the teeth are disposed on the base portion asymmetrically with respect to a line along which the roots are aligned.

72. The applicator of claim 52, wherein the base portion has a longitudinal axis extending substantially perpendicular to a longitudinal axis of said stem.

73. The applicator of claim 52, wherein said base portion has a longitudinal axis extending substantially in the same direction as a longitudinal axis of said stem.

74. The applicator of claim 52, wherein said base portion has two opposite ends and one of said ends is connected to a distal end of said stem.

75. The applicator of claim 52, wherein said base portion has two opposite ends, and said base portion being connected to a distal end of said stem along a part of said base portion located between the opposite ends.

76. The applicator of claim 52, wherein said stem includes a connector on a distal end of the stem, the connector being configured to connect the base portion to the stem.

77. The applicator of claim 76, wherein the connector defines a slot.

78. The applicator of claim 77, wherein the base portion is configured to be removably engaged in the slot.

79. The applicator of claim 78, wherein the roots of the teeth are configured to be engaged in the slot when the base portion is engaged in the slot.

80. The applicator of claim 75, wherein the stem and the base portion are molded as a single piece.

81. The applicator of claim 80, wherein the stem and the base portion are molded of plastic.

82. The applicator of claim 52, wherein at least one the teeth is flocked.

83. The applicator of claim 52, wherein at least one of the teeth has a hollow portion.

84. The applicator of claim 83, wherein the hollow portion extends along the length of said at least one tooth.

85. The applicator of claim 84, wherein at least one side of at least one side of the tooth has an opening leading to the hollow portion.

86. An applicator for applying a product to eyelashes, comprising:

a stem;

a base portion at one end of the stem; and at least one row of teeth including roots disposed on the base portion, the roots of consecutive teeth in said at least one row being substantially aligned along a plane, the consecutive teeth including portions extending from their roots being alternately offset on either side of said plane of alignment, and wherein the applicator is configured to apply the product to the eyelashes.

87. An applicator system comprising:

the applicator of claim 52; and a container configured to contain the product.

88. The system of claim 87, further comprising:

a wiper configured to remove excess product from said teeth when the applicator is removed from said container.

89. The system of claim 88, wherein the wiper is deformable.

90. The system of claim 88, wherein the wiper is chosen from an elastomeric lip and a block of foam.

91. The system of claim 87, wherein the product is contained in the container and the product is a cosmetic product for the eyelashes.

92. The system of claim 91, wherein said product is mascara.

93. The system of claim 87, wherein the container includes an opening configured to permit passage of at least a part of the base portion into the container, and wherein the system further comprises a cap at another end of the stem, the cap being configured to sealably close the opening.

94. An applicator system comprising:

the applicator of claim 86; and a container configured to contain the product.

95. The system of claim 94, further comprising:

a wiper configured to remove excess product from said teeth when the applicator is removed from said container.

96. The system of claim 95, wherein the wiper is deformable.

97. The system of claim 95, wherein the wiper is chosen from an elastomeric lip and a block of foam.

98. The system of claim 94, wherein the product is contained in the container and the product is a cosmetic product for the eyelashes.

99. The system of claim 98, wherein said product is mascara.

100. The system of claim 94, wherein the container includes an opening configured to permit passage of at least a part of the base portion into the container, and wherein the system further comprises a cap at another end of the stem, the cap being configured to sealably close the opening.

101. A method of applying a product to eyelashes, comprising:

providing the system of claim 1;

loading a product on at least some of the teeth; and placing at least some of the teeth in contact with the eyelashes such that the product coats the eyelashes.

102. The method of claim 101, wherein the container contains the product, and wherein the loading includes inserting the applicator into the container containing the product.

103. The method of claim 102, further comprising removing the applicator from the container and wiping excess product from the teeth.

104. The method of claim 101, wherein the loading the teeth includes dispensing the product from the container onto the teeth.

105. The method of claim 101, wherein the loading includes contacting the teeth with a solid cake of product.

106. The method of claim 105, further comprising moistening the solid cake of product.

107. The method of claim 101, further comprising gripping the eyelashes between adjacent teeth.

108. The method of claim 101, wherein the product is mascara.

109. The method of claim 108, wherein the mascara includes fibers, and wherein the method further comprises orienting the fibers with the teeth such that the fibers are substantially parallel to the eyelashes as the product is applied.

110. The method of claim 101, further comprising connecting a base portion of the applicator to a stem of the applicator, the teeth being disposed on the base portion.

111. The method of claim 110, further comprising selecting the base portion from a group of differing base portions.

112. A method applying a product to eyelashes, comprising:

providing the system of claim 87;

loading a product on at least some of the teeth; and placing at least some of the teeth in contact with the eyelashes such that the product coats the eyelashes.

113. The method of claim 112, wherein the container contains the product, and wherein the loading includes inserting the applicator into the container containing the product.

114. The method of claim 113, further comprising removing the applicator from the container and wiping excess product from the teeth.

115. The method of claim 112, wherein the loading includes dispensing the product from the container onto the teeth.

116. The method of claim 112, wherein the loading includes contacting the teeth with a solid cake of product.

117. The method of claim 116, further comprising moistening the solid cake of product.

118. The method of claim 112, further comprising gripping the eyelashes between adjacent teeth.

119. The method of claim 112, wherein the product is mascara.

120. The method of claim 119, wherein the mascara includes fibers, and wherein the method further comprises orienting the fibers with the teeth such that the fibers are substantially parallel to the eyelashes as the product is applied.

121. The method of claim 112, further comprising connecting the base portion of the applicator to the stem of the applicator, the teeth being disposed on the base portion.

122. The method of claim 121, further comprising selecting the base portion from a group of differing base portions and connecting the selected base portion to the stem.

123. A method applying a product to eyelashes, comprising:

providing the system of claim 94;

loading a product on at least some of the teeth; and placing at least some of the teeth in contact with the eyelashes such that the product coats the eyelashes.

124. The method of claim 123, wherein the container contains the product, and wherein the loading includes inserting the applicator into the container containing the product.

125. The method of claim 124, further comprising removing the applicator from the container and wiping excess product from the teeth.

126. The method of claim 123, wherein the loading includes dispensing the product from the container onto the teeth.

127. The method of claim 123, wherein the loading includes contacting the teeth with a solid cake of product.

128. The method of claim 127, further comprising moistening the solid cake of product.

129. The method of claim 123, further comprising gripping the eyelashes between adjacent teeth.

130. The method of claim 123, wherein the product is mascara.

131. The method of claim 130, wherein the mascara includes fibers, and wherein the method further comprises orienting the fibers with the teeth such that the fibers are substantially parallel to the eyelashes as the product is applied.

132. The method of claim 123, further comprising connecting the base portion of the applicator to the stem of the applicator, the teeth being disposed on the base portion.

133. The method of claim 132, further comprising selecting the base portion from a group of differing base portions and connecting the selected base portion to the stem.

* * * * *

UNITED STATES PATENT AND TRADEMARK OFFICE

CERTIFICATE OF CORRECTION

PATENT NO. : 6,581,610 B1
DATED : June 24, 2003
INVENTOR(S) : Jean-Louis H. Gueret It is certified that error appears in the above-identified patent and that said Letters Patent is hereby corrected as shown below:

Column 14,
Line 39, replace “observed a long” with -- observed along --; and

Column 17,
Line 32, replace “at least one the” with -- at least one of the --.

Signed and Sealed this

Ninth Day of September, 2003

JAMES E. ROGAN
*Director of the United States Patent and Trademark Office*